US005657996A

United States Patent [19]

Radgowski et al.

[11] Patent Number: 5,657,996

[45] Date of Patent: Aug. 19, 1997

[54] METHOD AND APPARATUS FOR TEACHING AND IMPROVING MANUAL DEXTERITY AND HAND/EYE COORDINATION

[76] Inventors: Christian J. Radgowski, 18 Old Sound Rd., Joppa, Md. 21085; Christopher G. Hyman, 2113 Baldwin Mill Rd., Fallston, Md. 21047

[21] Appl. No.: 514,732

[22] Filed: Aug. 14, 1995

[51] Int. Cl.[6] ..... A63B 65/00

[52] U.S. Cl. ..... 473/570; 434/258; 482/44; 273/447

[58] Field of Search ..... 273/58 R, 415, 273/341, 406, 412, 428, 440, 441, 449; 482/44, 45, 46, 109; 434/258

[56] References Cited

U.S. PATENT DOCUMENTS

| | | | |
|---|---|---|---|
| 2,238,713 | 4/1941 | Waring . | |
| 3,762,719 | 10/1973 | Smith | 473/212 |
| 3,770,275 | 11/1973 | Moore . | |
| 3,806,121 | 4/1974 | Crossley . | |
| 4,071,237 | 1/1978 | Hoogasian . | |
| 4,151,994 | 5/1979 | Stalberger | 273/428 |
| 4,943,066 | 7/1990 | Lathim et al. | 273/428 |
| 5,228,697 | 7/1993 | Gulick . | |
| 5,292,136 | 3/1994 | Cline . | |
| 5,310,194 | 5/1994 | Scheel . | |
| 5,338,027 | 8/1994 | Rehkemper et al. . | |
| 5,429,351 | 7/1995 | Hanson | 273/415 |

*Primary Examiner*—William M. Pierce
*Attorney, Agent, or Firm*—Richard C. Litman

[57] ABSTRACT

A method and apparatus for teaching and improving manual dexterity and hand/eye coordination, includes a generally rectangular solid object which is adapted to be flipped or tossed into the air and caught using solely the back of one hand, or the backs of the immediately adjacent finger segments. The object is relatively small and light, with at least slightly rounded corners, to preclude injury to the bony and unpadded back(s) of a person's hand and/or fingers. The object may include markings, instructions, and/or luminescence thereon, if desired. The method generally comprises moving the back of the hand and/or fingers to manipulate the object thereon. The object may be tossed into the air, using either the fingertips or from the back of one hand or the other, and caught by the tossing person or by another in a group. Other maneuvers may be made, including arcuately moving the arm and hand to invert the hand momentarily, and manipulating the hand so as to retain the object thereon throughout the maneuver, or catching the object behind the leg, etc. Manual dexterity and hand/eye coordination is much improved for an individual who has developed the skills required to perform the above maneuvers and exercises.

9 Claims, 3 Drawing Sheets

METHOD AND APPARATUS FOR TEACHING AND IMPROVING MANUAL DEXTERITY AND HAND/EYE COORDINATION

FIELD OF THE INVENTION

The present invention relates generally to methods and devices used in the teaching of various physical skills, and more specifically to a device and method of use thereof for teaching and improving manual dexterity and hand/eye coordination. The device is tossed in the air and caught on the back of the hand or proximal finger segments, in various maneuvers. The device may be used by a single individual, or in group exercise by two or more persons.

BACKGROUND OF THE INVENTION

Innumerable competitive games and sports have been developed over the years, which both provide an outlet for the competitive nature of the players, as well as naturally assisting in the development of manual dexterity and hand/eye coordination. Relatively simple games of catch, or other games involving the catching of a ball or the like (e.g., baseball, etc.) have been shown to be valuable in teaching such skills.

However, such games include formal rules, elaborate equipment, and require the use of at least two players even in a simple game of catch. While the present method and apparatus may be used with two or more persons, oftentimes there may be no one else available for play, or other persons may not wish or be able to play at that particular moment. Further, the typical game of catch is considered an outdoor activity which requires a fair amount of room, which may not always be available.

Moreover, due to the structure of the human hand, it is both a natural movement and also far easier to catch an object (ball, etc.) with the palm of the hand, than with any other portion of the hand or body. Indeed, some games have included rules prohibiting the use of the hands in catching or handling the ball, at least among some players in some circumstances, in order to provide additional challenge to the game; soccer is an example of such a game. However, no game or activity has been developed heretofore which requires the catching or manipulating of an object with the back of the hand or fingers, which activity provides extreme challenge due to the shape of the hand and the general lack of skill of most persons in using the back of the hand.

Accordingly, the present invention responds to the above by providing both an apparatus or article and a method of use thereof, for developing skills in manipulating and catching the article using the back of the hand or finger segments immediately adjacent thereto. As no specific competitive rules are required for play, the technique may be used by a single person playing alone, or may alternatively be used by two or more persons in a group. The technique lends itself to various maneuvers or tricks, which may be learned as skill in the use of the back of the hand increases. Moreover, the present method and apparatus lend themselves to use either indoors or outdoors and in various conditions, as the tossing and catching article may be made to be luminescent if desired for use at night or in a darkened environment, and the activity requires very little room, particularly when accomplished by a single individual.

DESCRIPTION OF THE PRIOR ART

U.S. Pat. No. 2,238,713 issued to Theodore R. Waring on Apr. 15, 1941 describes a Game using a flat stick which is tossed generally horizontally. Aerodynamic action causes the stick to tumble until it is close to the surface, whereupon surface effect causes the stick to cease its tumbling action and glide to the surface, in the manner of a wing. Scoring may be based upon which end of the stick first contacts the surface. The present tossing article is much smaller and narrower, and is adapted to be caught on the back of the hand, rather than being tossed to the ground. No rules or points are provided in the present method of play.

U.S. Pat. No. 3,770,275 issued to Robert B. Moore on Nov. 6, 1973 describes an Amusement And Exercise Device comprising a stick having two opposite paddle shaped ends, which is tossed end over end into the air, with a twisting motion. The object is to catch the stick by one end between the thumb and forefingers, after the stick has made at least one 360 degree end over end movement and one 180 degree twist. The back of the hand or fingers are not used, and no other more complex movements of the player are disclosed, as provided by the present method.

U.S. Pat. No. 3,806,121 issued to Charles E. Crossley on Apr. 23, 1974 describes a Sportsman's Muscle Developer Game Apparatus, comprising a hand grip rod with an elastic tether extending therefrom. The distal end of the tether has a golf ball or the like secured thereto. The object is to wind the tether onto the rod, then unwind the tether to lower the attached golf ball onto a golf tee. The operation is timed to determine a competitive score. No tossing or catching, particularly with the back of the hand or fingers, is disclosed.

U.S. Pat. No. 4,071,237 issued to Harold B. Hoogasian on Jan. 31, 1978 describes an Apparatus For Exercising Manual Coordination. A ball having six hooks in three mutually perpendicular axes is manipulated with a pair of flexible members having holes therethrough to catch the hooks of the ball. The flexible members are in turn pivotally installed on sticks, which are manipulated with the hands. The method of use requires grasping one stick with each hand, whereas the present method of developing manual dexterity uses only the back of the hand and/or immediately adjacent finger segments, with no gripping of the object occurring after it is tossed. The Hoogasian method does not toss the ball, as is done with the present method.

U.S. Pat. No. 5,228,697 issued to James D. Gulick et al. on Jul. 20, 1993 describes a Glow-In-The-Dark Golf Ball. While various other luminescent devices are known, none, including the Gulick et al. golf ball, are adapted to be caught on the surface of the back of the hand or adjacent finger segments, as provided by the present article of play.

U.S. Pat. No. 5,292,136 issued to Michael A. Cline on Mar. 8, 1994 describes a Game Of Skill wherein a ball is provided with a radial hole therein. The ball is secured to one of two sticks by a string or the like, and the object of the game is to transfer the ball back and forth from one stick to the other, using the sticks to capture the ball by means of the hole in the ball. Again, the palms and fingers are used to grip the sticks, with no manipulation of the ball being done directly or by the use of the backs of the hands or fingers, as provided by the present method and apparatus. The spherical nature of the ball precludes the catching of the ball on the back of the hand or adjacent finger segments, in any case.

U.S. Pat. No. 5,310,194 issued to Kenneth R. Scheel on May 10, 1994 describes a Centrifugally Launched Projectile Recreational Devicer comprising an elongate flexible object having a weight at one end and a gripping portion at the opposite end. The object is gripped with the fingers and palm and swung or tossed, to be caught (by the tosser or another person) using the palm and fingers to grasp any part of the object. No disclosure is made of a semi-rigid or solid object which is adapted to be caught using the back of the hand or adjacent finger segments, nor of the use of the back of the hand or adjacent finger segments in catching the Scheel object.

Finally, U.S. Pat. No. 5,338,027 issued to Jeffrey Rehkemper et al. on Aug. 16, 1994 describes a Tossing And Catching Play Object wherein a ball or disc is provided with extensions simulating animal legs (e.g., frog legs). The appendages tend to create an unstable aerodynamic path for the article when it is thrown, but also tend to preclude significant travel over the surface after landing. The device is not adapted for catching using the back of the hand or fingers, and no disclosure is made of using the back of the hand or adjacent finger segments to catch any of the embodiments of the Rehkemper device.

None of the above noted patents, taken either singly or in combination, are seen to disclose the specific arrangement of concepts disclosed by the present invention.

SUMMARY OF THE INVENTION

By the present invention, an improved method and apparatus for teaching and improving manual dexterity and hand/eye coordination is disclosed.

Accordingly, one of the objects of the present invention is to provide an improved method which includes the manipulation of an object using the back of the hand and/or the backs of the immediately adjacent finger segments to catch or support the object.

Another of the objects of the present invention is to provide an improved method which includes the tossing of an object into the air, and catching the object using only the back of the hand and/or the backs of the finger segments immediately adjacent thereto.

Yet another of the objects of the present invention is to provide an improved method wherein a single person manipulates the object.

Still another of the objects of the present invention is to provide an improved method wherein the object is alternatingly tossed from one person to another in a group of people, with each person catching the object using only the back of the hand and/or the backs of the finger segments immediately adjacent thereto.

A further object of the present invention is to provide an improved method which includes different means of manipulation of the object, including catching the object behind one leg after tossing, tossing the object back and forth from the back of one hand or fingers to the back of the opposite hand or fingers, and manipulating the object to remain in place on the back of one hand or fingers while arcuately inverting the hand.

An additional object of the present invention is to provide an improved apparatus for use with the present method, which object is adapted for catching or supporting on the back of the hand or immediately adjacent finger segments during manipulation of the object.

Another object of the present invention is to provide an improved apparatus which comprises a generally rectangular solid article having rounded corners thereon, which article may include different colors, markings, and/or luminescence.

Yet another object of the present invention is to provide an improved apparatus which is substantially three eighths of an inch thick by seven eighths of an inch wide by three and three quarters of an inch long, and which mass is substantially nineteen grams.

A final object of the present invention is to provide an improved method and apparatus for teaching and improving manual dexterity and hand/eye coordination for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the figures of the attached drawings.

DETAILED DESCRIPTION OF THE PREFERRED EMBODIMENTS

Figure 1:
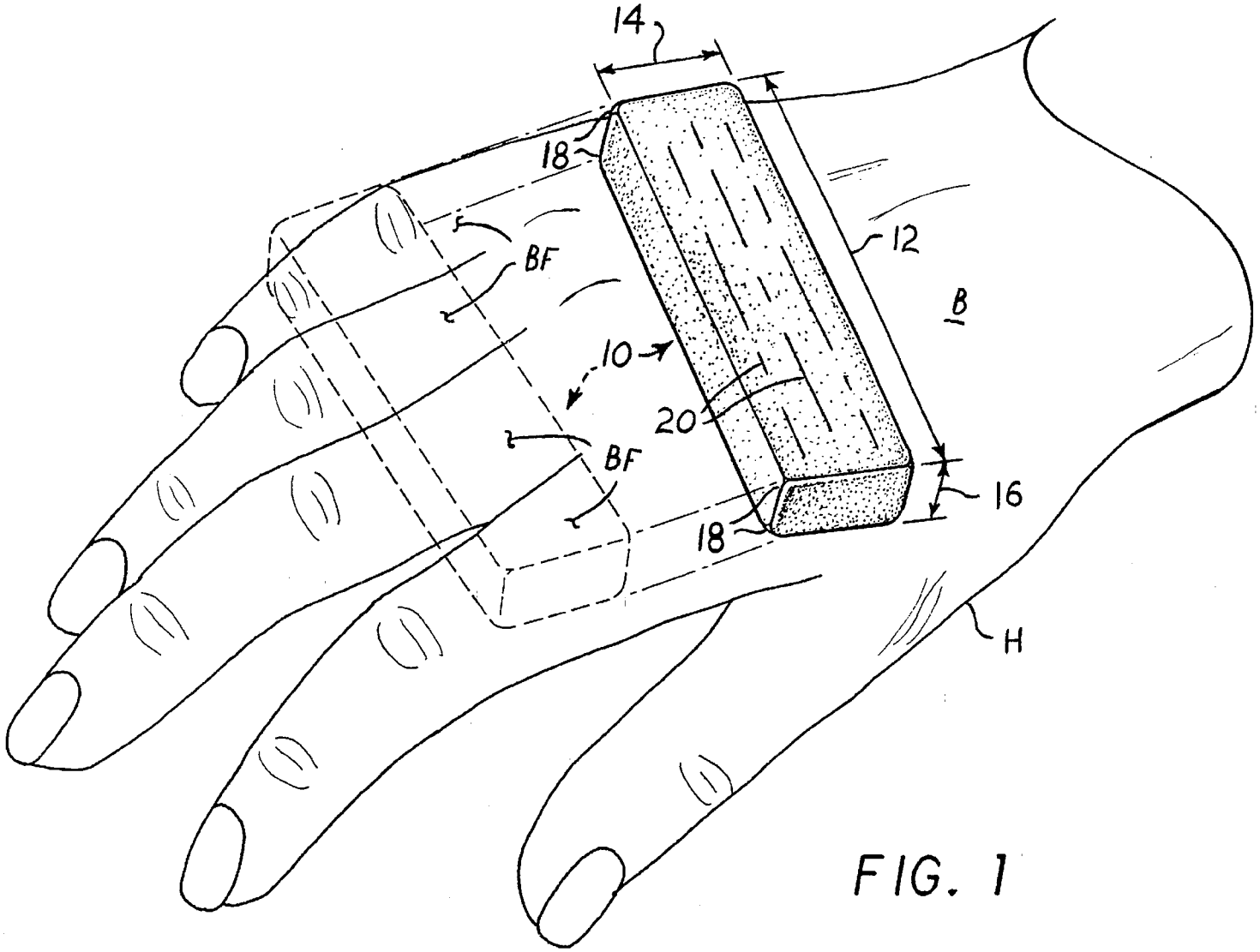
FIG. 1 is a top perspective view of a tossing article or object of the present invention resting upon the back of the hand of a person in accordance with the present method of use, with an alternative position on the backs of the finger segments immediately adjacent to the back of the hand being shown in broken lines.

Referring now to the drawings, the present invention will be seen to relate to a method and apparatus for teaching and improving manual dexterity and hand/eye coordination, wherein a tossing object 10 is manipulated, tossed, and/or caught by a person using solely the back B of the hand H, and/or the backs BF of the immediately adjacent segments of the fingers. (While the object 10 is shown resting upon the back B of the hand H in solid lines in FIG. 1, it will be understood that the alternate position shown in broken lines may also be used, wherein the object is manipulated using the backs BF of the segments of the fingers which are immediately adjacent to the hand H, and defined anatomically by the proximal phalanx bones.)

The object 10 shown in FIG. 1 is preferably a relatively small and light rectangular parallelepiped, with linear dimensions substantially on the order of three and one quarter inches by seven eighths of an inch by three eighths of an inch for the length 12, width 14, and thickness 16, respectively. The object 10 is preferably monolithically formed of solid plastic to have a mass substantially on the order of nineteen grams, although other solid or hollow materials may be used as desired, so long as the dimensions and mass are reasonably close to those specified above. The relatively light mass serves to preclude injury to the typically unpadded and bony structure of the back B of the hand H or backs BF of the fingers, should the object 10 glance off the back(s) of the hand or fingers without being caught. The corners 18 may be rounded as desired, to further reduce the likelihood of injury. The above described features render the tossing object 10 to be well adapted for catching and manipulation using the back of the hand and/or the backs of the immediately adjacent finger portions, as defined by the proximal phalanges extending from the carpal bones of the hand.

Optionally, the object 10 may include some form of display means 20 thereon, on one or more of the surfaces thereof. The display means 20 may be in the form of a decorative color or pattern of colors, instructional information, advertising, etc. As an added challenge to persons using the object 10, it may be made to be luminescent for use at night or in conditions of low light.

Figure 2:
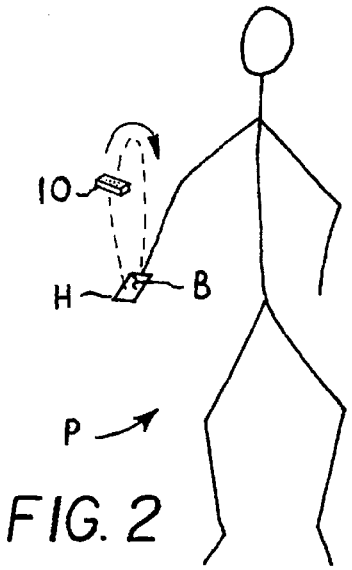
FIG. 2 is a schematic drawing of a single person using the method of tossing and catching the object of FIG. 1, on the back of one hand or adjacent finger segments.

FIGS. 2 through 6 provide schematic views to indicate some of the maneuvers or exercises which may be performed by individuals or by a group of participants, using the tossing object 10 and the back(s) of one or both hands and/or adjacent finger segments. FIG. 2 provides a view of one of the simpler tricks or operations which may be performed according to the present invention. In FIG. 2, an individual person P is shown tossing the tossing object 10 into the air, using the back B of his/her hand H. (The back B of the hand(s) H is/are shown schematically in the form of a generally upwardly facing rectangle(s) in FIGS. 2 through 6; the palm(s) of the hand(s) are facing generally downward. It will be further understood that the backs B of the hands H in FIGS. 2 through 6 also includes at least the backs of the finger segments immediately adjacent to the hand.)

The person P may toss the object 10 into the air conventionally, if desired, using the fingers of the catching hand H or the opposite hand as desired, or alternatively may place the object 10 on the back B of the hand H or backs of the adjacent finger portions and flip the object 10 into the air using a sharp upward movement of the hand H, and catch the object 10 using the back B of the same hand H (or backs of the fingers) which was used to toss the object 10 into the air. This maneuver may be repeated as desired, with further practice providing development and improvement of manual dexterity and hand/eye coordination, particularly in the use of the relatively unpracticed use of the back of the hand and/or backs of the fingers for the tossing, catching, and/or manipulation of objects.

Figure 3:
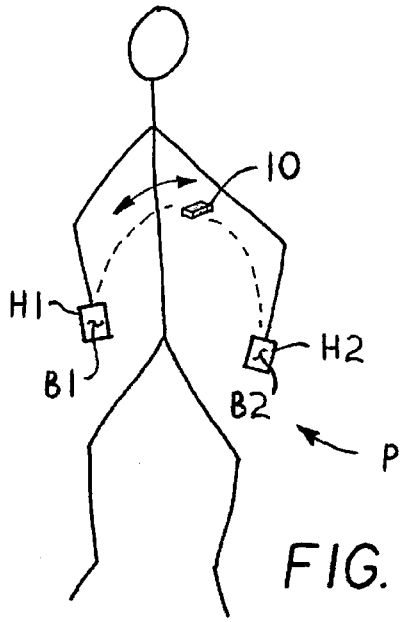
FIG. 3 is a schematic drawing of a single person using the method of tossing and catching the object of FIG. 1, alternating between the backs of both hands or adjacent finger segments.

FIG. 3 provides a schematic view of a somewhat more advanced exercise, in which an individual person P alternatingly tosses the object 10 from the back B1 of one hand H1 to the back B2 of the opposite hand H2. (Again, it will be understood that the backs of the fingers may also be used to perform the exercises of FIGS. 2 through 6, and that reference to the backs of the hands may also include the backs of the finger segments immediately adjacent to the hands.) Initially, the person P may either toss the object 10 upwardly using the fingers of one hand, and catch the object 10 on the back of the tossing hand or the opposite hand, as desired. Alternatively, the object 10 may be placed upon the back B1/B2 of one or the other of the hands H1/H2, and the exercise initiated by flipping the object 10 into the air from the back B1/B2 of one of the hands H1/H2, and catching the object 10 on the back B1/B2 of the opposite hand H1/H2. The maneuver may be repeated as desired, either slowly or rapidly, as skill permits. As most persons have a dominant hand, this exercise will be seen to be of value in developing dexterity and hand/eye coordination using the non-dominant hand, as well as the dominant hand.

Figure 4:
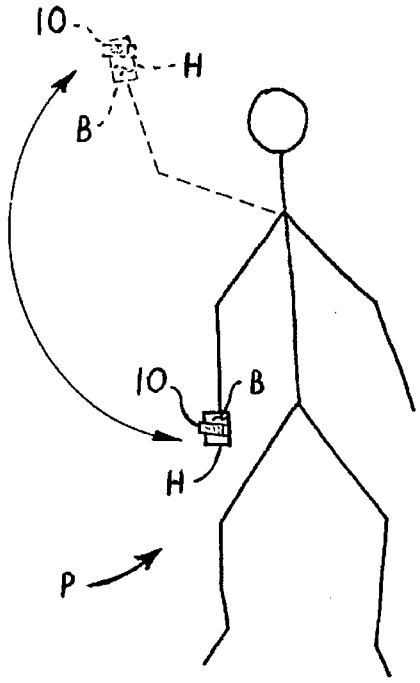
FIG. 4 is a schematic drawing of a single person using the method of arcuately swinging the arm and back of the hand to a momentarily inverted position, moving the back of the hand to preclude the falling of the object therefrom.

FIG. 4 provides a variation on the tossing of the object 10. In FIG. 4, the person P maneuvers the hand H so as to retain the object 10 continually on the back B thereof, without allowing the object 10 to leave the hand. This is particularly challenging when the hand H is maneuvered to momentarily invert the back B to face downward, as shown in the alternative position in broken lines in FIG. 4. However, by smoothly moving the hand H in an arcuate motion, centripetal force may be used advantageously to retain the object 10 against the momentarily inverted back B of the hand H, before smoothly returning the hand H to the lower position in a reciprocal arcuate motion with the back B of the hand H upright. This maneuver is fascinating both to watch and to perform properly, and requires great skill to be developed in smoothness and coordination, particularly in the movement of the non-dominant hand.

Figure 5:
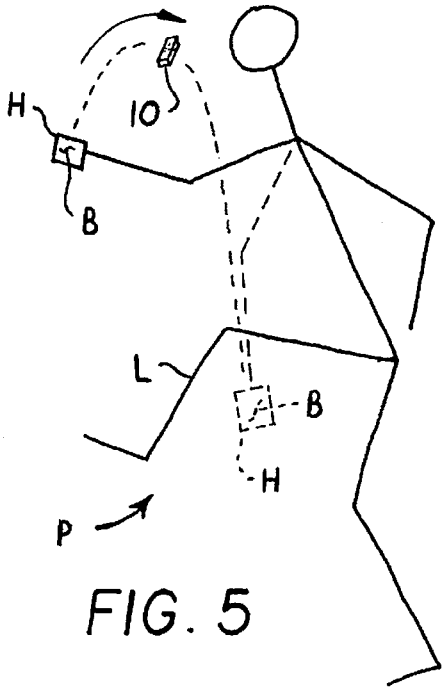
FIG. 5 is a schematic drawing of a single person tossing the object and catching it behind one leg.

Another advanced tossing exercise or maneuver is shown in FIG. 5, wherein the object 10 is tossed in the air from the hand H in a first position, shown in solid lines, with one leg L being rapidly lifted and the hand H then being rapidly lowered and maneuvered to a position behind and beneath the leg L, as indicated by the position of the hand H shown in broken lines in FIG. 5. As in the case of the other maneuvers, the object 10 may be initially tossed into the air using either the back of one hand, or alternatively the fingers of one hand, either the catching hand or the opposite hand, as desired. Greater challenge incurs by tossing the object 10 by using the back B of the same hand H as that used to catch the object 10 behind the leg L, due to the additional time required to lift the leg and reposition the hand H thereunder.

Figure 6:
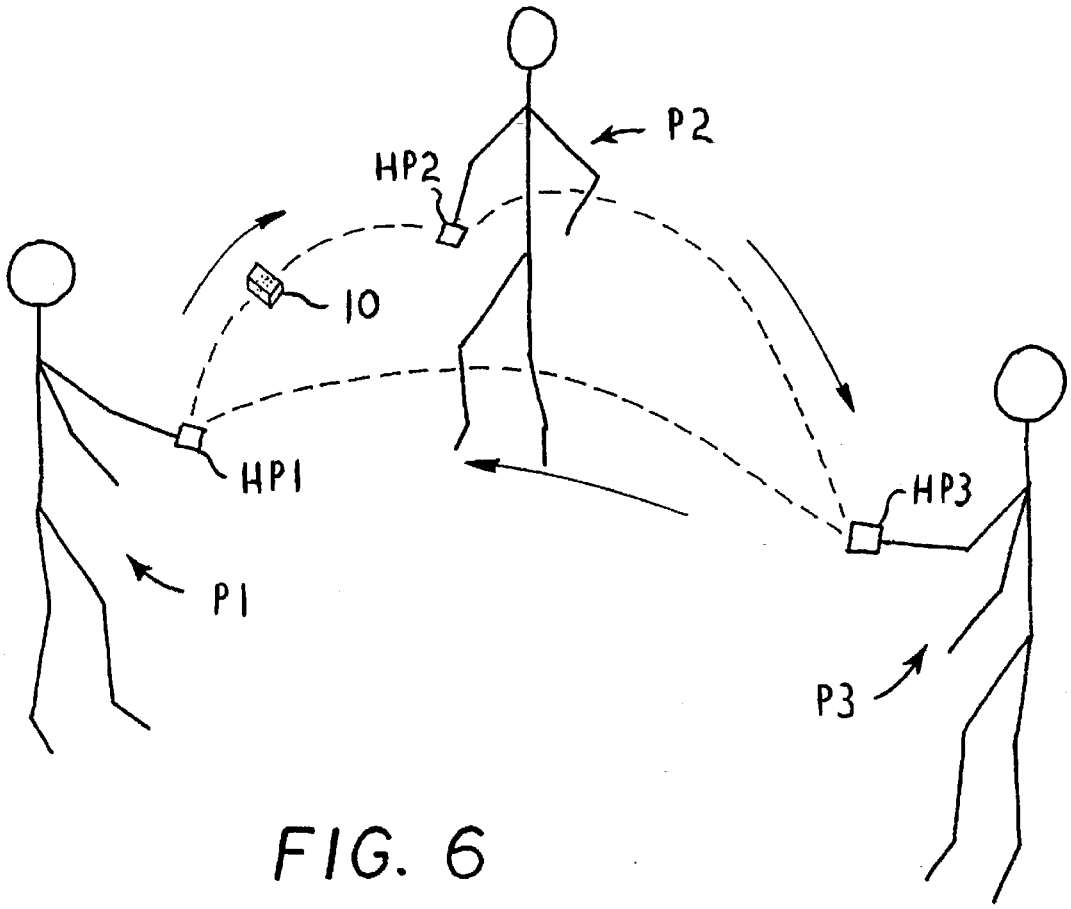
FIG. 6 is a schematic drawing of a group of persons alternatingly tossing the object from one person to another, and alternatingly catching it on the backs of their hands or adjacent finger segments.

The above described exercises, maneuvers, or tricks are not limited to performance by a single person, but may also be performed by a group of two or more persons, as indicated by the persons P1, P2, and P3 of FIG. 6. In FIG. 6, the object 10 is being tossed from a first person P1 to a second person P2, and thence to a third person P3, before being returned to the first person P1 to repeat the cycle. As in FIGS. 2 through 5, the back of the hand and/or backs of the fingers (respectively HP1, HP2, and HP3 for the persons P1 through P3) is/are used to catch the object 10, and for sufficiently skilled participants, the object 10 may be tossed from the back(s) of the same hand/fingers which was/were used to catch the object 10, or flipped from the back(s) of the catching hand/fingers to the back(s) of the opposite hand/fingers for the subsequent toss, with the object 10 never being manipulated by the front or gripping surfaces of the fingers of any participant once the tossing round has begun. While three persons P1 through P3 are shown in FIG. 6, it will be understood that any number of persons may play, as desired.

In summary, the above described method and apparatus for teaching and improving manual dexterity and hand/eye coordination will be seen to teach skills in the use of the back(s) of one or both hands, and/or the backs of the finger segments immediately adjacent to the hands, which no other method or apparatus has taught heretofore. The method is not competitive, with no scoring being provided, in order that those less skilled may still involve themselves without concern for their performance. Yet, the more advanced maneuvers and tricks can be quite challenging to learn, particularly when using the non-dominant hand for all maneuvers and/or working behind the leg, back, etc. The present method may also be used indoors by a single individual for those maneuvers requiring relatively little room or movement, such as tossing the object into the air and catching it on the back(s) of the same or opposite hand or fingers. In fact, while the various drawing figures show standing persons, most of the maneuvers described may be performed by a seated person, if desired. Yet, even a relatively large group of persons may enjoy the activity, if desired, with each participating at his or her own level of skill, as his/her ability permits.

The tossing object is specially formed to adapt to tossing and catching using the back(s) of the hand and/or fingers, without fear of injury to the back(s) of the hand/fingers from an excessively large, heavy, or sharp object, yet the object has sufficient mass and inertia to penetrate through the air reasonably well to allow tossing from one person to another. The object may be used as a promotional and/or advertising device, if desired, by use of the display means which may be provided thereon, in the manner of "Pogs" (tm) and other relatively inexpensive devices. Alternatively, bright colors and designs, and/or luminescence may be provided, to enhance play after dark or in areas of low light.

It is to be understood that the present invention is not limited to the sole embodiments described above, but encompasses any and all embodiments within the scope of the following claims.

I claim:

1. A method for teaching and improving manual dexterity and hand/eye coordination, comprising the following steps:

(a) providing an object for manipulation by using the back of a person's hand, including the backs of the finger segments immediately adjacent thereto;

(b) placing the object upon the back of the hand;

(c) manipulating and moving the back of the hand in a smooth arcuate motion, wherein centripetal force is used to retain the object against the back of the hand; and (d) returning the back of the hand in a reciprocal smooth arcuate motion, while continually retaining the object on the back of the hand.

2. The method of claim 1, including the steps of:

(a) momentarily inverting the back of the hand having the object thereon, in a smooth arcuate motion, and;

(b) returning the back of the hand in a reciprocal smooth arcuate motion to an upright position, while continually retaining the object on the back of the hand.

3. The method of claim 1, including the steps of:

(a) tossing the object generally upwardly into the air, and;

(b) catching the object on the back of the tossing hand and selectively retaining the object thereon as desired after the catch.

4. The method of claim 1, including the steps of:

(a) tossing the object generally upwardly into the air, and;

(b) catching the object on the back of the hand opposite the tossing hand and selectively retaining the object thereon as desired after the catch.

5. The method of claim 1, including the steps of:

(a) tossing the object generally upwardly into the air;

(b) maneuvering the back of one hand behind one leg, and;

(c) catching the object on the back of the hand behind the one leg and selectively retaining the object thereon as desired after the catch.

6. The method of claim 1, including the steps of:

(a) providing a group of participating persons, and;

(b) tossing the object alternatingly between each of the persons, with each of the persons catching the object on the back of one hand and selectively retaining the object thereon until tossing the object to another of the persons.

7. The method of claim 6, including the steps of:

(a) each of the participating persons alternatingly catching the object on the back of one hand, and;

(b) tossing the object to another person by using the same hand to toss the object as was used to catch the object.

8. The method of claim 6, including the steps of:

(a) each of the participating persons alternatingly catching the object on the back of one hand;

(b) transferring the object from the back of the catching hand to the back of the opposite hand, and;

(c) tossing the object to another person by using the opposite hand to toss the object from that used to catch the object.

9. The method of claim 6, including the steps of:

(a) each of the participating persons alternatingly tossing the object to another catching person;

(b) having the catching person maneuver the back of one hand behind one leg, and;

(c) catching the object on the back of the hand behind the one leg before tossing the object to another of the participating persons for the catching thereof behind the leg.

* * * * *